US010089914B2

(12) United States Patent
Lee et al.

(10) Patent No.: US 10,089,914 B2
(45) Date of Patent: Oct. 2, 2018

(54) DISPLAY CONTROL METHOD AND APPARATUS

(71) Applicant: SAMSUNG DISPLAY CO., LTD., Yongin-si, Gyeonggi-Do (KR)

(72) Inventors: Giljae Lee, Yongin-si (KR); Kyungman Kim, Yongin-si (KR)

(73) Assignee: SAMSUNG DISPLAY CO., LTD., Yongin-si, Gyeonggi-do (KR)

( * ) Notice: Subject to any disclaimer, the term of this patent is extended or adjusted under 35 U.S.C. 154(b) by 336 days.

(21) Appl. No.: 14/832,460

(22) Filed: Aug. 21, 2015

(65) Prior Publication Data

US 2016/0203754 A1 Jul. 14, 2016

(30) Foreign Application Priority Data

Jan. 13, 2015 (KR) ..... 10-2015-0006111

(51) Int. Cl.
*G09G 3/20* (2006.01)
*G09G 5/00* (2006.01)

(52) U.S. Cl.
CPC ..... *G09G 3/2092* (2013.01); *G09G 5/003* (2013.01); *G09G 2320/0257* (2013.01); *G09G 2320/046* (2013.01); *G09G 2354/00* (2013.01)

(58) Field of Classification Search
CPC ..... G09G 3/2092; G09G 5/003; G09G 2320/0257; G09G 2320/046; G09G 2354/00
USPC ..... 345/156, 214
See application file for complete search history.

(56) References Cited

U.S. PATENT DOCUMENTS 6,384,816 B1 * 5/2002 Tabata ..... G02F 1/13471 345/204
6,429,833 B1 * 8/2002 Ryeom ..... G09G 3/2037 345/60
9,654,693 B2 * 5/2017 Van Den Herik ..... H04N 5/23293
2003/0076332 A1 4/2003 Choi
2010/0066757 A1 3/2010 Kondo et al.
2010/0118006 A1 * 5/2010 Kimura ..... G09G 3/3611 345/205
2012/0113107 A1 * 5/2012 Jang ..... G02B 27/26 345/419
2013/0100123 A1 4/2013 Hakoda et al.
2014/0333532 A1 * 11/2014 Ohbitsu ..... H04N 13/0022 345/156

FOREIGN PATENT DOCUMENTS

KR 10-2003-0032564 A 4/2003
KR 10-2004-0073863 A 8/2004
KR 10-2009-0090657 A 8/2009

* cited by examiner

*Primary Examiner* — Stacy Khoo
(74) *Attorney, Agent, or Firm* — Lee & Morse, P.C.

(57) ABSTRACT

A display control method includes obtaining a viewing distance of a viewer from a display panel, determining a parameter including a movement distance for moving a position of each pixel of an image displayed on the display panel, based on the viewing distance, and periodically moving the position of each pixel of the image by the movement distance.

10 Claims, 3 Drawing Sheets

DISPLAY CONTROL METHOD AND APPARATUS

CROSS-REFERENCE TO RELATED APPLICATION

Korean Patent Application No. 10-2015-0006111, filed on Jan. 13, 2015, in the Korean Intellectual Property Office, and entitled: "Display Control Method and Apparatus," is incorporated by reference herein in its entirety.

BACKGROUND

1. Field

Embodiments relate to a display control method and apparatus.

2. Description of the Related Art

In general, an afterimage of a display device is caused when one image is displayed for a predetermined time period. In particular, when a display surface of a display device is formed of, e.g., a fluorescent material, a severe afterimage is caused.

SUMMARY

Embodiments are directed to a display control method, including obtaining a viewing distance of a viewer from a display panel, determining a parameter including a movement distance for moving a position of each pixel of an image displayed on the display panel, based on the viewing distance, and periodically moving the position of each pixel of the image by the movement distance.

The parameter may include a movement distance in each of a horizontal direction and a vertical direction.

The determining may include determining the parameter so that the movement distance increases as a ratio between the viewing distance and a preset reference viewing distance increases.

The determining may include determining a distance corresponding to the viewing distance by referring to a look-up table that is previously stored.

The obtaining may include further obtaining a viewing direction of the viewer, and the determining may include determining the movement distance as a preset maximum value when the viewing direction exceeds a preset direction range.

The obtaining may include further obtaining information about whether the view views the image, and the determining may include determining the movement distance as a preset maximum value when the viewer does not view the image.

The parameter may further include a movement speed, and the periodically moving may include periodically moving the position of each pixel of the image by the movement distance at the movement speed.

The movement speed may increase as a ratio between the viewing distance and a preset reference viewing distance increases.

The obtaining may include further obtaining a viewing direction of the viewer, and the determining may include determining the movement speed as a preset maximum value when the viewing direction exceeds a preset direction range.

The obtaining may include further obtaining information about whether the viewer views the image, and the determining may include determining the movement speed as a preset maximum value when the viewer does not view the image.

Embodiments are also directed to a display control apparatus, including a viewer information obtainer that obtains a viewing distance of a viewer, a parameter determiner that determines a parameter including a movement distance for moving a position of each pixel of an image displayed on a display panel based on the viewing distance, and a display controller that periodically moves the position of each pixel of the image by the movement distance.

Embodiments are also directed to a non-transitory computer-readable recording medium having embodied thereon a program for executing a method according to an embodiment.

BRIEF DESCRIPTION OF THE DRAWINGS

Features will become apparent to those of skill in the art by describing in detail example embodiments with reference to the attached drawings in which.

DETAILED DESCRIPTION

Figure 1:
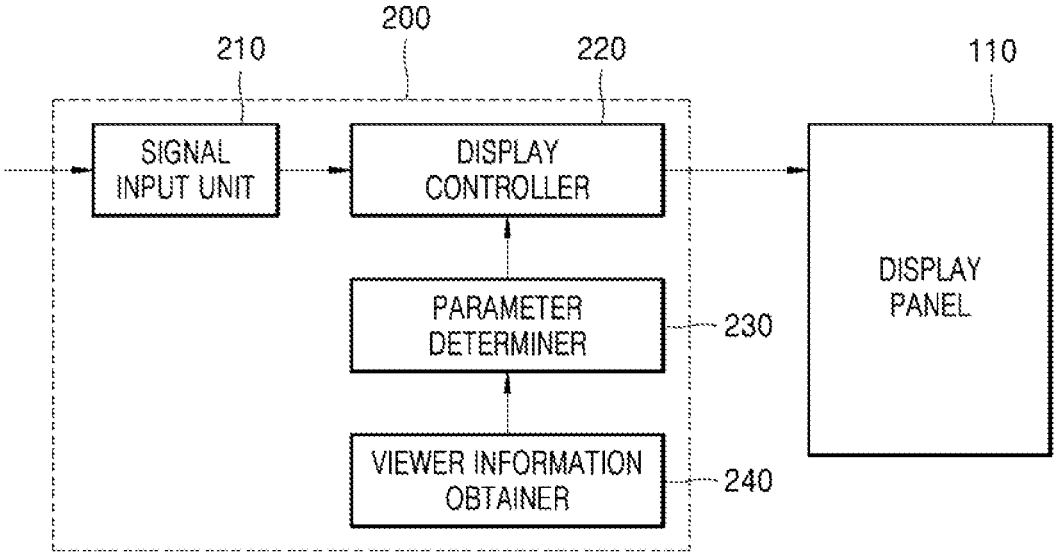
FIG. 1 illustrates a block diagram illustrating a display panel and a display control apparatus for controlling the display panel, according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey example implementations to those skilled in the art.

In the drawing figures, the dimensions of layers and regions may be exaggerated for clarity of illustration. Like reference numerals refer to like elements throughout.

As used herein, the term "and/or" includes any and all combinations of one or more of the associated listed items. Expressions such as "at least one of" when preceding a list of elements, modify the entire list of elements and do not modify the individual elements of the list.

As used herein, the singular forms "a", "an", and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

In the following examples, the x-axis, the y-axis, and the z-axis are not limited to three axes of the rectangular coordinate system, and may be interpreted in a broader sense. For example, the x-axis, the y-axis, and the z-axis may be perpendicular to one another, or may represent different directions that are not perpendicular to one another.

FIG. 1 is a block diagram illustrating a display panel 110 and a display control apparatus 200 for controlling the display panel 110, according to an example embodiment.

Referring to FIG. 1, the display panel 110 and the display control apparatus 200 for controlling the display panel 110 are provided. A display device according to an example embodiment may be provided to include the display panel 110 and the display control apparatus 200.

The display panel 110 includes a plurality of pixels, and displays an image by emitting light according to a signal that is applied from the display control apparatus 200.

The display control apparatus 200 receives an image signal from the outside, and controls the display panel 110 to display an image on the display panel 110 based on the received image signal.

The display control apparatus 200 may perform pixel shifting for periodically moving an overall position of the image displayed on the display panel 110 in order to prevent a phenomenon where an afterimage remains on the display panel 110. The term 'pixel shifting' refers to an image processing method of horizontally or vertically moving all pixels included in an image frame. The display control apparatus 200 may perform the pixel shifting in a preset cycle by horizontally or vertically moving or rotating the image. The pixel shifting may have the effect of a screen saver.

The display control apparatus 200 may determine a movement distance and a movement speed of each pixel of the image per period when the pixel shifting is performed. Once the pixel shifting is performed, an afterimage may be prevented. However, a movement of the pixel may be perceived by a user according to the movement distance and the movement speed of the pixel. As the movement distance and the movement speed of the pixel increase, an afterimage prevention effect may improve, but a movement of the entire image may be more clearly perceived by the user, which may be noticed by the user, perhaps causing user discomfort.

The display control apparatus 200 according to an example embodiment determines a parameter of the pixel shifting so that an afterimage prevention effect is maximized and a movement of the pixel is prevented from being perceived by the user by taking into account the user's viewing distance. The parameter of the pixel shifting includes the movement distance and the movement speed of the pixel. The movement distance may include a movement distance in each of a horizontal direction and a vertical direction. The movement speed may include a movement speed in each of the horizontal direction and the vertical direction.

The display control apparatus 200 includes a signal input unit 210, a display controller 220, a parameter determiner 230, and a viewer information obtainer 240.

The signal input unit 210 receives an image signal.

The display controller 220 controls an image displayed on the display panel 110. The display controller 220 may perform pixel shifting in order to prevent an afterimage when the image is displayed. According to an example embodiment, when a pixel value of the image displayed on the display panel 110 does not change for a preset time period, that is, when the image is displayed as a static image for the preset time period, the pixel shifting may be performed. When the pixel value of the image displayed on the display panel 110 changes while the pixel shifting is performed, the display controller 220 may stop the pixel shifting. Whether the image is a static image may be determined for the entire display panel 110, or the display panel 110 may be divided into a plurality of areas, and whether the image is a static image may be determined for each of the areas. When the image is displayed as a static image in some areas, the pixel shifting may be performed only on said areas in which the image is displayed as a static image. However, when the pixel shifting is performed only on said areas, the image may be distorted, thereby reducing image quality. In order to address this aspect, the display controller 220 may perform the pixel shifting on the entire image even when the image is displayed as a static image only in some areas.

According to another example embodiment, the display controller 220 may periodically perform the pixel shifting irrespective of whether the image displayed on the display panel 110 is a static image or a moving image.

The parameter determiner 230 determines a parameter of the pixel shifting to be applied to the image. The display controller 220 controls the image displayed on the display panel 110 to periodically move based on the determined parameter.

The viewer information obtainer 240 obtains information about a viewing state of a viewer (i.e., a user). For example, the viewer information obtainer 240 obtains a viewing distance of the viewer. The viewing distance is a distance from the display panel 110 to the viewer. The display device may include a sensor to obtain viewer information. The sensor may include an infrared sensor or a camera. The viewer information obtainer 240 may calculate the viewing distance from a sensing value of the infrared sensor or calculate the viewing distance by using a size of the viewer included in an image captured by the camera, and may output the calculated viewing distance to the parameter determiner 230.

The viewer information obtainer 240 may further obtain a viewing direction of the viewer. The viewing direction may be defined as an angle of the eyes of the viewer with respect to a path that connects the display panel 110 and the viewer. The viewer information obtainer 240 may obtain the viewing direction by using a sensor. For example, the viewing direction may be obtained by analyzing a direction of the eye pupils of the viewer included in the image captured by the camera.

The viewer information obtainer 240 may further obtain information about whether the viewer views the image. The viewer information obtainer 240 may determine whether the viewer views the image by using a sensor. For example, the viewer information obtainer 240 may analyze the eyes of the viewer included in the image captured by the camera, and may determine that the viewer views the image when the eyes of the viewer are opened and determine that the viewer does not view the image when the eyes of the viewer are closed.

The parameter determiner 230 may obtain the viewer information from the viewer information obtainer 240 and may determine the parameter based on the viewer information. The viewer information includes at least one selected from information about the viewing distance, information about the viewing direction, and information about whether the viewer views the image.

The parameter determiner 230 determines the parameter based on the viewing distance of the viewer. For example, the parameter determiner 230 may determine the parameter so that the movement distance of the pixel increases as the viewing distance of the viewer increases. The parameter determiner 230 may determine the parameter so that the movement speed of the pixel increases as the viewing distance of the viewer increases. The parameter determiner 230 may determine the parameter by referring to a look-up table between the viewing distance and the parameter that is previously stored, or by using a calculation method that is previously stored.

The parameter determiner 230 may determine the parameter so that the movement distance of the pixel increases as a ratio between the viewing distance of the viewer and a preset reference viewing distance increases. The parameter determiner 230 may determine the parameter so that the movement speed of the pixel increases as the ratio between the viewing distance of the viewer and the preset reference viewing distance increases. The parameter determiner 230 may determine the parameter by referring to a look-up table between the parameter and the ratio between the viewing distance and the preset reference viewing distance that is previously stored, or by using a calculation method that is previously stored.

The parameter determiner 230 may determine the parameter based on the viewing direction of the viewer. For example, the parameter determiner 230 may set the parameter as a maximum value when the viewing direction of the viewer exceeds a preset direction range. For example, when the viewing direction of the viewer exceeds the direction range, the parameter determiner 230 may determine the movement distance and the movement amount of the pixel as preset maximum values.

The parameter determiner 230 may determine the parameter based on whether the viewer views the image. For example, when the viewer does not view the image, the parameter determiner 230 may set the parameter as a maximum value. The viewer information obtainer 240 may obtain information about whether the viewer views the image by analyzing the eyes of the viewer included in the captured image as described above.

The parameter determiner 230 may consider the viewing direction and whether the viewer views the image than the viewing distance, from among the viewing distance, the viewing direction, and whether the viewer views the image. For example, the parameter determiner 230 may set the parameter as a maximum value when the viewing direction exceeds the preset direction range or when it is determined that the viewer does not view the image, irrespective of the viewing distance. The parameter determiner 230 may determine the parameter based on the viewing distance of the viewer when the viewing direction of the viewer is within the preset direction range and when it is determined that the viewer views the image. In detail, the parameter determiner 230 may set the parameter so that the movement speed and the movement amount of the pixel increase as the viewing distance increases.

Figure 2:
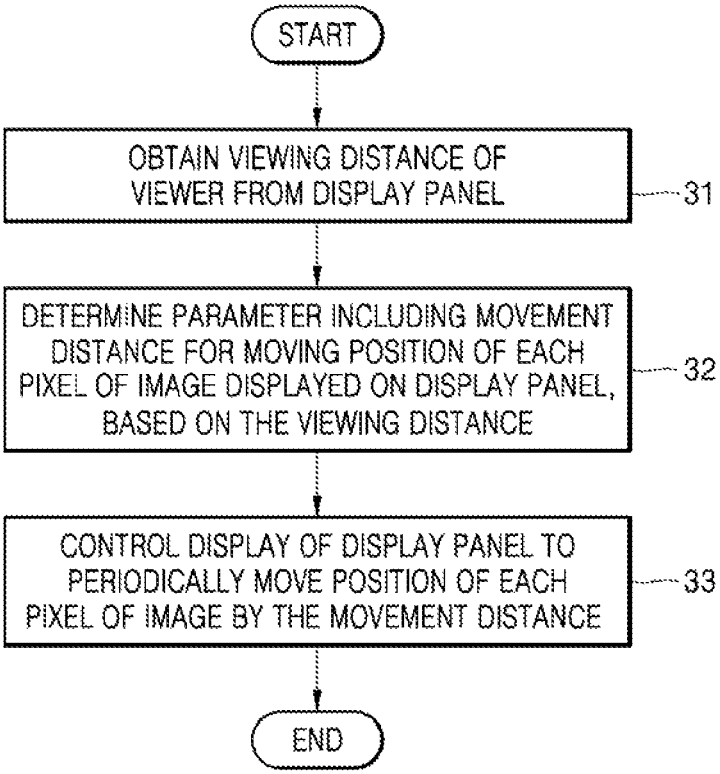
FIG. 2 illustrates a flowchart of a display control method according to an example embodiment.

FIG. 2 is a flowchart of a display control method according to an example embodiment.

The display control method of FIG. 2 includes operations that are sequentially performed. Accordingly, the description above regarding the elements of FIG. 1 may apply to the display control method of FIG. 2.

Referring to FIG. 2, in operation 31, the viewer information obtainer 240 (see FIG. 1) obtains a viewing distance of a viewer from the display panel 110. In operation 31, the viewer information obtainer 240 may further obtain a viewing direction of the viewer on the display panel 110 and determine whether the viewer views an image.

In operation 32, the parameter determiner 230 (see FIG. 1) determines a parameter of pixel shifting including a movement distance for moving a position of each pixel of the image displayed on the display panel 110, based on the viewing distance obtained in operation 31. The parameter may include a movement distance in each of a horizontal direction and a vertical direction. The parameter may further include a movement speed. The parameter may include a movement speed in each of the horizontal direction and the vertical direction.

In operation 32, the parameter determiner 230 may determine the parameter so that the movement distance increases as the viewing distance increases. The parameter determiner 230 may determine the parameter so that the movement distance increases as a ratio between the viewing distance and a preset reference viewing distance increases.

In operation 32, the parameter determiner 230 may determine the parameter by further considering the viewing direction and whether the viewer views the image obtained in operation 31. For example, when the viewing direction of the viewer exceeds a preset direction range, the parameter determiner 230 may set the movement distance included in the parameter as a maximum value. For example, when the viewer does not view the image, the parameter determiner 230 may set the movement distance as a maximum value.

In operation 33, the display controller 220 (see FIG. 1) controls the image displayed on the display panel 110 so that the position of the pixel of the image periodically moves by the movement distance determined in operation 32.

Figure 3:
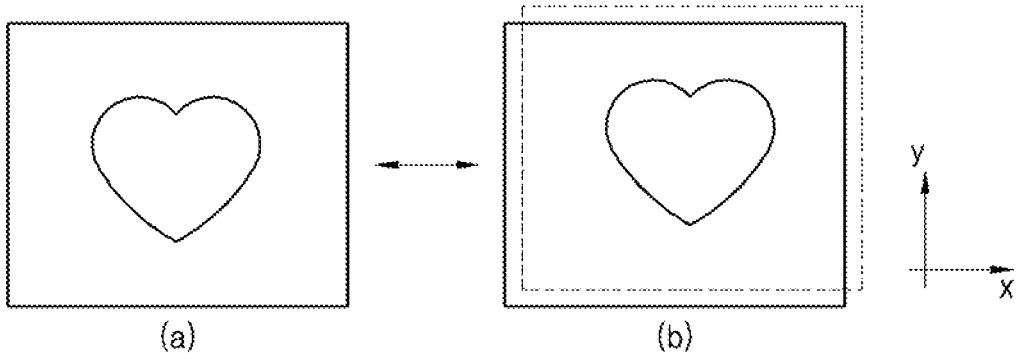
FIG. 3 illustrates a view for explaining pixel shifting according to an example embodiment.

FIG. 3 is a view for explaining pixel shifting according to an example embodiment.

In (a) of FIG. 3, it is assumed that an image is continuously displayed as a static image on the display panel 110. An image of (a) of FIG. 3 is an original image according to an image signal input from the outside. An image of (b) of FIG. 3 is an image obtained by moving positions of pixels by using pixel shifting.

Once pixel shifting is performed, a position of each pixel of the image (a) of FIG. 3 may be moved in a horizontal direction (X-axis) and a vertical direction (Y-axis), and thus, the image of (a) of FIG. 3 may change to the image of (b) of FIG. 3 and may return to the image of (a) of FIG. 3. As the pixel shifting is performed, a periodic change may occur from the image of (a) of FIG. 3 to the image of (b) of FIG. 3, or from the image of (b) of FIG. 3 to the image of (a) of FIG. 3.

Figure 4:
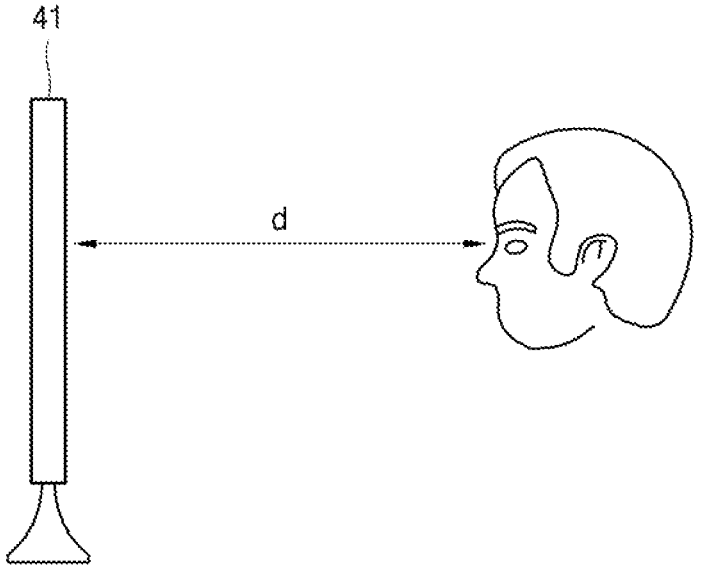
FIG. 4 illustrates a view for explaining a viewing distance of a viewer, according to an example embodiment.

FIG. 4 is a view for explaining a viewing distance of a viewer, according to an example embodiment. Referring to FIG. 4, a distance 'd' between a display device 41 and a viewer may be measured by using a sensor, and a parameter of pixel shifting may be determined based on the measured viewing distance 'd'.

Figure 5A:
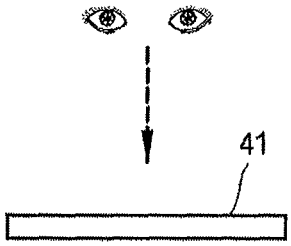
FIGS. 5A through 5C illustrate views for explaining a viewing direction of a viewer and whether the viewer views an image, according to an example embodiment.
Figure 5B:
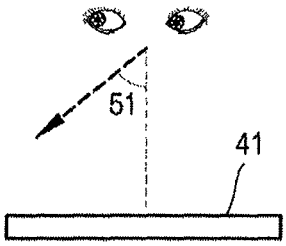
Figure 5C:
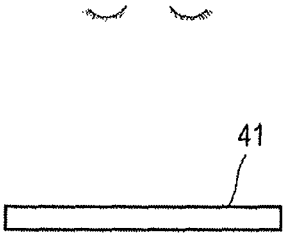

FIGS. 5A through 5C are views for explaining a viewing direction of a viewer and whether the viewer views an image, according to an example embodiment. In FIG. 5A, the viewer faces the front of the display device 41 and is viewing the front of the display device 41. A reference direction range in which it may be assumed that the viewer sees the display device 41 may be previously stored. In FIG. 5A, a viewing direction may be within a preset direction range, and a parameter of pixel shifting may be determined based on a viewing distance.

In FIG. 5B, the viewer does not face the front of the display device 41, and the viewing direction exceeds the reference direction range. Accordingly, the parameter of the pixel shifting may be determined as a maximum value. The viewing direction of the viewer may be expressed by using an angle 51 between the viewing direction and a path between the display device 41 and a position of the viewer.

In FIG. 5C, the viewer may close his/her eyes, and the viewer information obtainer 240 (see FIG. 1) may analyze an image of the eyes of the viewer and may determine that the viewer does not view the image. In this case, the parameter determiner 230 (see FIG. 1) may determine the parameter of the pixel shifting as a maximum value.

According to the one or more example embodiments, there may be provided pixel shifting that may prevent a viewer who views an image from feeling that an image appears different from an original image and may maximize an afterimage prevention effect.

As described above, according to the one or more of the above example embodiments, a display control method and apparatus may reduce a user's discomfort and may improve an afterimage prevention effect by adjusting a degree of pixel shifting for preventing an afterimage according to the user's viewing state.

The display control method of FIG. 2 may be implemented as an executable program, and may be executed by a general-purpose digital computer that runs the program by using a computer-readable recording medium. Examples of the computer-readable recording medium include storage media such as read only memories (ROMs), magnetic storage media (e.g., floppy discs or hard discs) and optically readable media (e.g., compact disk-read only memories (CD-ROMs) or digital versatile disks (DVDs)).

According to an example embodiment, a computer program that may execute the display control method according to the example embodiment in a computer and a distribution server that distributes the computer program are provided. These general and specific aspects may be implemented by using a system, a method, a computer program, or any combination thereof.

By way of summation and review, in order to prevent an afterimage of a display device, an image processing method may detect whether one image is displayed for a predetermined time period, and if it is detected that the one image is displayed for the predetermined time period, may control a display device to display a preset on-screen display (OSD) image instead of the one image that was being displayed, to set the display device to a standby mode, or to move a position of the one image by certain pixels. Such an image processing method for preventing an afterimage may result in a user perceiving a change on a screen and thus sensing that an image appears different from an original image.

As described above, embodiments relate to a display control method and apparatus for preventing an afterimage of a display device. One or more example embodiments include a display control method and apparatus for preventing an afterimage of a display device and reducing user discomfort.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display control method, comprising:

obtaining a viewing distance of a viewer from a display panel;

determining a parameter including a movement distance for moving a position of each pixel of an image displayed on the display panel, based on the viewing distance; and periodically moving the position of each pixel of the image by the movement distance, wherein the determining includes determining the parameter so that the movement distance increases as a ratio between the viewing distance and a preset reference viewing distance increases.

2. The display control method as claimed in claim 1, wherein the movement distance corresponds to a movement distance in a horizontal direction and a movement distance in a vertical direction.

3. The display control method as claimed in claim 1, wherein the determining includes determining a distance corresponding to the viewing distance by referring to a look-up table that is previously stored.

4. The display control method as claimed in claim 1, wherein:

the obtaining includes further obtaining a viewing direction of the viewer, and the determining includes determining the movement distance as a preset maximum value when the viewing direction exceeds a preset direction range.

5. The display control method as claimed in claim 1, wherein:

the obtaining includes further obtaining information about whether the viewer views the image, and the determining includes determining the movement distance as a preset maximum value when the viewer does not view the image.

6. The display control method as claimed in claim 1, wherein:

the parameter further includes a movement speed, and the periodically moving includes periodically moving the position of each pixel of the image by the movement distance at the movement speed.

7. The display control method as claimed in claim 6, wherein the movement speed increases as a ratio between the viewing distance and a preset reference viewing distance increases.

8. The display control method as claimed in claim 6, wherein the obtaining includes further obtaining a viewing direction of the viewer, and the determining includes determining the movement speed as a preset maximum value when the viewing direction exceeds a preset direction range.

9. The display control method as claimed in claim 6, wherein:

the obtaining includes further obtaining information about whether the viewer views the image, and the determining includes determining the movement speed as a preset maximum value when the viewer does not view the image.

10. A non-transitory computer-readable recording medium having embodied thereon a program for executing the method as claimed in claim 1.

* * * * *